US008453450B2

(12) United States Patent
Berger

(10) Patent No.: US 8,453,450 B2
(45) Date of Patent: Jun. 4, 2013

(54) STEAM TURBINE PLANT

(75) Inventor: Fred Berger, Weinheim (DE)

(73) Assignee: Alstom Technology Ltd, Baden (CH)

( * ) Notice: Subject to any disclaimer, the term of this patent is extended or adjusted under 35 U.S.C. 154(b) by 291 days.

(21) Appl. No.: 13/033,300

(22) Filed: Feb. 23, 2011

(65) Prior Publication Data

US 2011/0203274 A1 Aug. 25, 2011

(30) Foreign Application Priority Data

Feb. 24, 2010 (EP) ..... 10154526

(51) Int. Cl.
*F01K 7/22* (2006.01)
*F01K 27/00* (2006.01)

(52) U.S. Cl.
USPC ..... 60/643; 60/653; 60/662; 60/663; 60/666

(58) Field of Classification Search
USPC ..... 60/643, 653, 662, 663, 666, 646, 60/457, 677–679
See application file for complete search history.

(56) References Cited

U.S. PATENT DOCUMENTS

| | | | |
|---|---|---|---|
| 4,031,863 | A | 6/1977 | Läubli |
| 4,576,008 | A | 3/1986 | Silvestri, Jr. |
| 6,647,727 | B2 | 11/2003 | Klatt et al. |

FOREIGN PATENT DOCUMENTS

| | | | |
|---|---|---|---|
| CH | 582851 | | 12/1976 |
| DE | 44 32 960 | | 11/1995 |
| DE | 102 27 709 | A1 | 2/2003 |
| DE | 10 2008 029941 | A1 | 5/2009 |
| GB | 2 453 849 | A | 4/2009 |

OTHER PUBLICATIONS

Search Report dated Aug. 1, 2011, issued in the corresponding German Patent Application No. 10 2011 011 123.9.
European Search Report for EP 10 15 4526 dated Dec. 30, 2010.

*Primary Examiner* — Thomas E. Denion
*Assistant Examiner* — Laert Dounis
(74) *Attorney, Agent, or Firm* — Buchanan Ingersoll & Rooney PC

(57) ABSTRACT

An exemplary steam plant having a steam circuit which includes a superheater defining a boundary between a superheated steam region and an unsuperheated steam region. The steam circuit includes a branch, from a superheated steam region of the steam circuit, with a branch valve and a steam desuperheater upstream of the branch valve. The desuperheater provides cooling to the branch during flow mode operation of the branch. During a no flow mode, a first preheat line and a second preheat line provide the cooling by supplying unsuperheated steam to the branch and directing this flow through to a lower pressure region of the steam circuit.

9 Claims, 2 Drawing Sheets

STEAM TURBINE PLANT

RELATED APPLICATION

This application claims priority under 35 U.S.C. §119 to European Patent Application No. 10154526.7 filed in Europe on Feb. 24, 2010, the entire content of which is hereby incorporated by reference in its entirety.

FIELD

The present disclosure relates to steam turbine plants with steam circuits and branches including turbine bypasses and vent lines with relief valves, and to the temperature control of the branches during both flow and no flow modes of operation.

BACKGROUND INFORMATION

Steam circuits of steam plants can include different temperature regions wherein higher temperature regions can be made of materials with higher heat strength that can be more expensive than lower heat strength materials used in lower temperature regions. Due to a difference in cost between materials of differing heat strength, it can be advantageous to reduce the temperature in high temperature branches, such as steam turbine bypasses, of the steam circuit.

GB patent application No. 2 453 849 A discloses the use of a water injection cooler for reducing the temperature exposure in a branch. The cooler functions by spraying water in the branch so that it comes in direct contact with the steam to be cooled. While this can be effective in reducing steam temperature to the point where lower temperature alloys may be used, the disclosed system uses a steam flow to operate and therefore cannot be universally applied to branches with no flow modes, such as bypasses, bleeds or vent lines and still ensure low temperature in the branch during all operating modes.

As an alternative, IPCOM000176170D discloses injecting an inert gas in a branch that acts as a heat buffer during no flow modes of operation. When the branch is, for example, a turbine bypass, the change from no flow to flow mode may result in the inert gas entering the steam circuit. Unless removed with additional equipment, the inert gas can have a negative affect on steam turbine efficiency. In addition, this does not address the thermal shock that may occur when the branch is brought into flow mode from a no flow mode, as the method is not able ensure an adequate temperature is maintained in the branch.

An alternative is to provide external heating and cooling elements over the branch piping and associated equipment. While such arrangements are physically possible such solutions can add significant complexity and cost to the steam plant.

SUMMARY

A steam plant according to the disclosure includes a steam circuit, a superheater in the steam circuit defining a boundary between a superheated steam region and an unsuperheated steam region, and a branch from the superheated steam region of the steam circuit. The branch includes a branch valve and a steam desuperheater, upstream of the branch valve, having a cooling medium feed line. A first preheat line is connected at a first end to an unsuperheated steam region and at a second end, to a first end region of the branch. A second preheat line connected at a first end, to a second end region of the branch, upstream of the branch valve, distal and opposite the first end region and at a second end, to a point of the steam circuit that in operation has a lower pressure than the unsuperheated region to which the first preheat line is connected, so as to enable sequential steam flow through the first preheat line, the branch and the second preheat line respectively when the branch valve is closed.

A method is disclosed for controlling a steam plant, having a superheater in a steam circuit for defining a boundary between a superheated steam region and an unsuperheated steam region. A branch from the superheated steam region of the steam circuit includes a branch valve and a steam desuperheater with a cooling medium feed line. A first preheat line is connected at a first end to an unsuperheated steam region and at a second end to a first end region of the branch. A second preheat line is connected at a first end to a second end region of the branch upstream of the branch valve which is distal and opposite the first end region, and at a second end to a point of the steam circuit that in operation has a lower pressure than the unsuperheated region to which the first preheat line is connected, so as to enable sequential steam flow through the first preheat line, the branch and the second preheat line respectively when the branch valve is closed. The method includes closing the branch valve; isolating a cooling medium flow from the steam desuperheater, and opening a valve in at least one of the first preheat line and the second preheat line to enable sequential flow of unsuperheated steam through the first preheat line, the branch and the second preheat line.

A method is disclosed for controlling a steam plant having a superheater in a steam circuit for defining a boundary between a superheated steam region and an unsuperheated steam region. A branch from the superheated steam region of the steam circuit includes a branch valve and a steam desuperheater, with a cooling medium feed line. A first preheat line is connected at a first end to an unsuperheated steam region and at a second end to a first end region of the branch. A second preheat line is connected at a first end to a second end region of the branch upstream of the branch valve which is distal and opposite the first end region, and at a second end to a point of the steam circuit that in operation has a lower pressure than the unsuperheated region to which the first preheat line is connected, so as to enable sequential steam flow through the first preheat line, the branch and the second preheat line respectively when the branch valve is closed. The method includes closing the branch valve, establishing cooling medium flow to the steam desuperheater, and closing a valve in the second preheat line.

BRIEF DESCRIPTION OF THE DRAWINGS

Other aspects and advantages of the present disclosure will become apparent from the following description, taken in connection with the accompanying drawings, which by way of example illustrate embodiments of the present disclosure.

DETAILED DESCRIPTION

Figure 1:
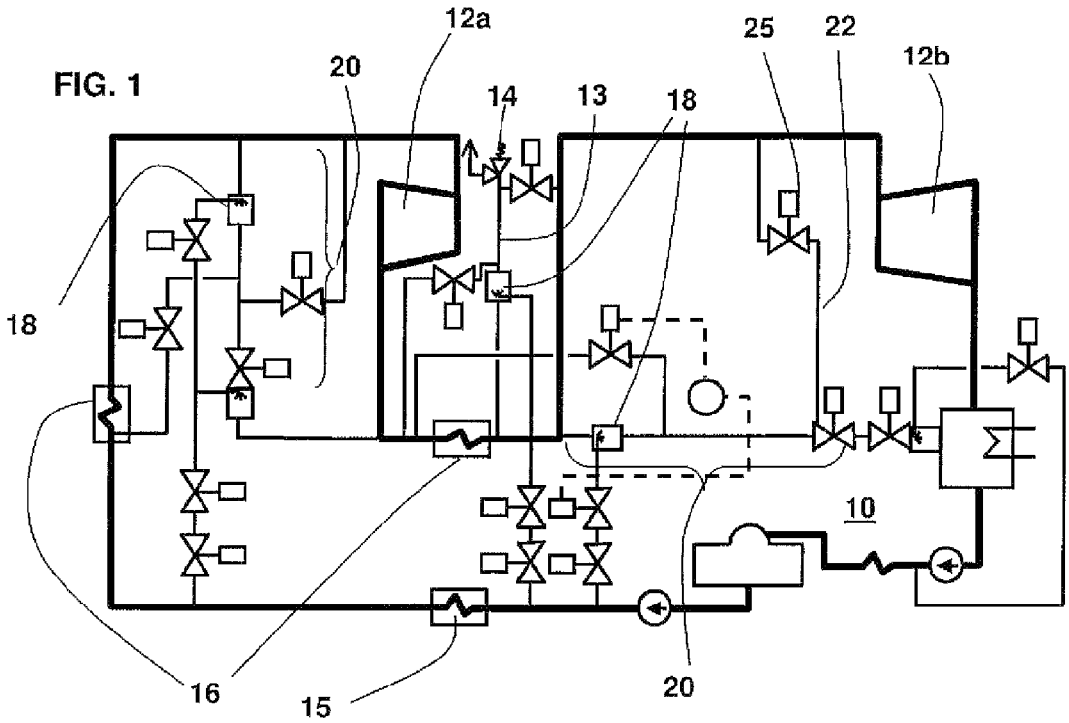
FIG. 1 is a schematic view of a steam plant according to an exemplary embodiment of the disclosure.

Exemplary embodiments of the disclosure can address the high temperature in steam circuit branches that have both flow and no flow modes of operations.

The disclosure is based, at least in part, on the general idea of using a combination of low temperature steam and water injection cooling to control the temperature in steam plant branches.

An exemplary embodiment of the disclosure provides a steam plant with a steam circuit having a superheater that defines a boundary between a superheated steam region (e.g., a higher temperature region of any known steam turbine) and an unsuperheated steam region (e.g., a region of lower temperature, by a specified margin, as compared to the higher temperature region of the same steam turbine). The steam circuit has a branch from the superheated steam region that, at a downstream region, has a branch valve and at an upstream region, a steam desuperheater. The steam desuperheater provides a means to control the temperature of the branch when it is in flow mode. During no flow mode for example, when the branch valve is shut, first and second preheat lines can control the temperature of the branch. They can achieve this, in an exemplary embodiment, by the first preheat line being connected, at a first end, to a unsuperheated steam region, and, at a second end, to an first end region of the branch. Meanwhile, the second preheat line is connected, at a first end, to a second end region of the branch, opposite and distal the first end region, and, at a second end, to a point of the steam circuit configured in operation to have a lower pressure than the unsuperheated steam region to which the first preheat line is connected. This configuration of the preheat lines can promote sequential flow of the unsuperheated steam flow through the first preheat line, the branch, and the second preheat line.

A means can thus be provided for limiting, independent of the flow mode of the branch, the temperature in the branch. In this way, a means to overcome the high temperature in the branch can be provided and thus can enable the use of less expensive lower hot strength materials of construction in the branch.

In various exemplary embodiments, the branch can be either a steam turbine bypass or a vent line with a relief valve.

In order to reduce unwanted steam leakage through the preheat lines during branch flow mode, in an exemplary embodiment, the second preheat line includes a valve, which can be an actuated block valve, check valve or manual valve.

In an exemplary embodiment, the branch can include a temperature controller for controlling the temperature in the branch during no flow mode. A control system cannot only ensure that the branch temperature can be maintained below a maximum temperature, it can enable the temperature to be maintained within a temperature range and thus avoid thermal shock concerns when changing flow modes.

In an exemplary embodiment, the controller can include a flow restricting device, in either or both the first preheat line or the second preheat line. Such a controller can provide a simple, economic means of control.

In another exemplary embodiment, the controller can include a flow modulating valve in the first preheat line, a flow modulating valve in a cooling medium feed line of the steam desuperheater, and a temperature measurement device in the branch. The temperature measurement measures the temperature of the branch. Such a controller can provide tight, predictable temperature control.

Exemplary embodiments of the present disclosure are now described with reference to the drawings, wherein like reference numerals are used to refer to like elements throughout. In the following description, for purposes of explanation, numerous specific details are set forth to provide a thorough understanding of the disclosure. However, the present disclosure may be practiced without these specific details and so is not limited to the exemplary embodiments disclosed herein.

In this specification, reference is made to superheated steam and unsuperheated steam. While unsuperheated steam shall be taken to mean steam that has not been superheated, unsuperheated steam cannot be taken to mean merely saturated steam as unsuperheated steam may contain a low degree of superheat. As a result, throughout this specification, superheated steam is taken to mean steam that has more than 100° C. of superheat above any superheat, unsuperheated steam may have.

In this specification reference is made to valves in terms of: location, for example, branch valve; function, for example, modulating or block; or design, for example, relief or actuated. In the absence of a particular qualifying term the valve can be taken to encompass all known suitable valves for the given purpose. The presence of a qualifying term, however, does not place a restriction on other properties of a valve. For example, a valve designated as an actuated valve may be either a modulating valve or a block valve.

FIG. 1 shows a steam plant 10 whose purpose is to extract heat from a heat source and convert this heat into power. This can be achieved by the use of a steam circuit in which heat energy can be transferred into the steam circuit by, for example, heat exchangers and later extracted, for example, by multiple steam turbines 12, such as a high pressure steam turbine 12*a*, in combination with a low pressure steam turbine 12*b*. The closed loop steam circuit can also include a condensate region and so a steam circuit is not taken to mean "consisting exclusively of steam."

Some elements of a steam circuit of an exemplary steam plant 10 shown in FIG. 1 will now be explained in more detail. The steam circuit, as a continuous loop, has a steam preheater 15 for vaporising/heating condensate in the steam circuit. After preheating in the preheater 15, steam is superheated in a superheater 16 and fed to a high-pressure steam turbine 12 where energy is extracted. Exhaust from the high-pressure steam turbine 12 is once more superheated in a further superheater 16 and then fed into an intermediate and/or low-pressure steam turbine 12 for further energy extraction. The exhaust from the steam turbine 12 is condensed and, in completing the cycle, returned to the preheater 15. While the exemplary steam plant 10 of FIG. 1 is shown with two steam turbines 12, exemplary embodiments can be applied to steam plants 10 configured with one steam turbine 12 or alternatively more than two steam turbines 12.

The steam circuit of a steam plant 10 can include branches 20 that span high and lower temperature regions of the steam circuit or else provide outlets from the steam circuit. These branches 20 can have both flow and no flow modes. In the context of this specification, the terms flow and no flow modes refer to the state of flow or no flow of the steam circuit steam/condensate and not to auxiliary heating and/or cooling flows, such as preheat flows, even if these flows are taken directly from the steam circuit. Exemplary branches 20, as shown in FIG. 1, include vent lines 13 with relief valves 14 as well as steam turbine bypass lines whose purpose can be to either totally or partially direct steam flow around a steam turbine 12.

Figure 2:
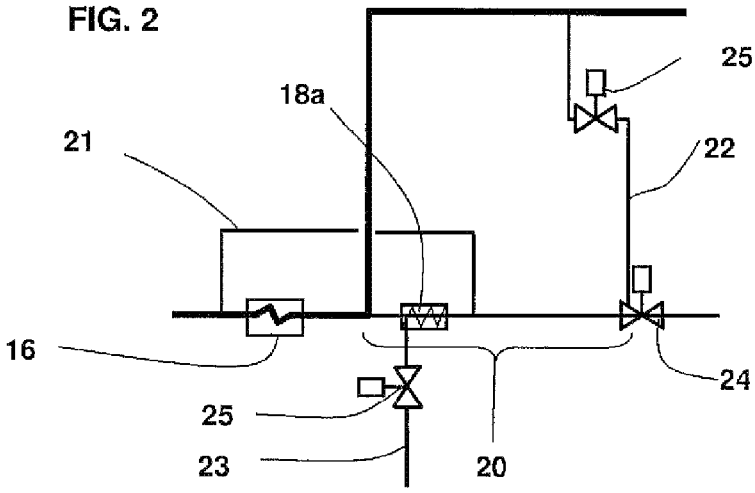
FIG. 2 is a schematic view of an exemplary branch of the steam plant of FIG. 1 showing details of a branch.

In an exemplary embodiment, shown in FIG. 2, a branch 20 includes a branch valve 24, which can be used to isolate the branch 20 from the process and thus can prevent steam flow through the branch 20. The branch 20 further includes a steam desuperheater 18, upstream of the branch valve 24, to cool the branch 20 downstream of the steam desuperheater 18. In this way, locating the branch valve 24 downstream of the steam desuperheater 18 also can ensure it is kept cool and therefore can be made of lower hot strength material.

In an exemplary embodiment where the branch 20 is a vent line 13, the branch valve 24 can be a relief valve 14.

In an exemplary embodiment, the steam desuperheater 18 can be configured to desuperheat steam from 735° C., where a suitable alloy is a nickel alloy, such as NiCr 23 Co 12 Mo, to below 600° C. and thus enable the use of a lower hot strength material such as 9-12% martensitic Cr-steel. In another exemplary embodiment, when 600° C. steam is desuperheated, a change from, for example, a 9-12% martensitic Cr-steel to a 10CrMo910 steel or equivalent can be made. In each case, the material change can be made after about 10-15 pipe diameters downstream of the steam desuperheater 18. This can ensure there is adequate time for the material of the branch to cool before the material change is made.

Figure 3:
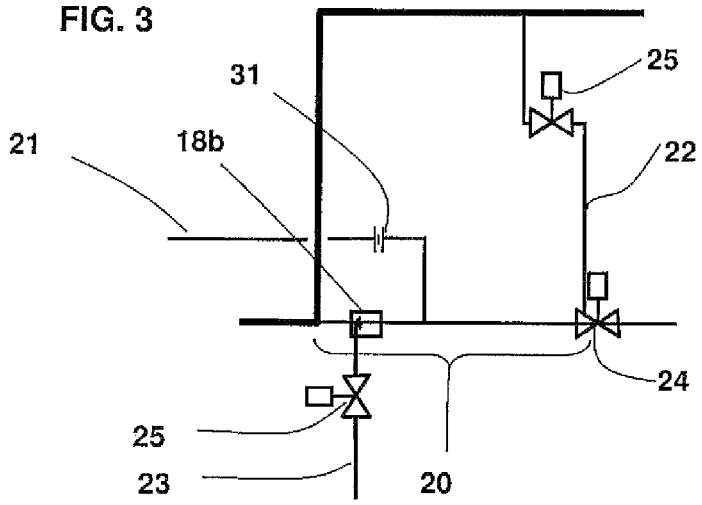
FIG. 3 is a schematic view of an exemplary branch of the steam plant of FIG. 1 showing the components of a temperature control system of the branch.
Figure 4:
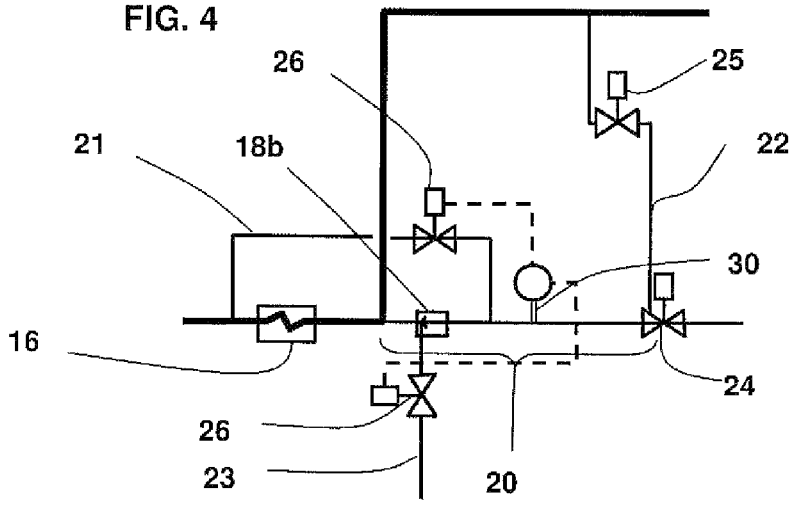
FIG. 4 is a schematic view of an exemplary branch of the steam plant of FIG. 1 showing the components of another temperature control system of the branch.

The steam desuperheater 18, shown in FIG. 2-4, can desuperheat steam by mixing or injecting a cooling medium with the superheated steam as it enters the branch 20 from the steam circuit. The cooling medium can be provided to the steam desuperheater 18 by a cooling medium feed line 23 in which a valve 25 can be located for either or both isolation or control purposes.

As shown in FIG. 2, in an exemplary embodiment, the desuperheater 18*a* can be a mixer in which unsuperheated steam is used as the cooling medium.

As shown in FIGS. 3 and 4, in an exemplary embodiment, the desuperheater 18*b* is a water injection cooler that can utilise water or condensate, sourced from the steam circuit, as the cooling medium.

During no flow mode, for example when the branch valve 24 is shut, an arrangement of preheat lines 21,22 can be used, as shown in FIGS. 1-4, to control the temperature in the branch 20 downstream of the steam desuperheater 18. The control of the temperature not only enables the use of lower hot strength materials it also can prevent damage caused by thermal shock when the branch 20 is brought into flow mode.

In an exemplary embodiment shown in FIG. 2-4, the first preheat line 21 is connected, at a first end, to an unsuperheated region of the steam circuit. In separate exemplary embodiments, shown in FIG. 1, this is either at a point between the steam turbine 12 exhaust and steam superheater 16 or between the steam preheater 15 and the superheater 16. At a second end, the first preheat line 21 is connected to a first end region of the branch 20.

The second preheat line 22 is connected at a first end, to a second end region, opposite and distal from the first end region, of the branch 20. At a second end, the second preheat line 22 is connected to a point of the steam circuit configured in operation to have a lower pressure than the unsuperheated steam region at which the first preheat line 21 is connected to. An example of such a location is the feed line of one of the steam turbines 12, such as a low pressure steam turbine 12*b* as shown in FIG. 1. This configuration enables sequential flow of unsuperheated steam through the first preheat line 21, the branch 20 and then finally through the second preheat line 22 and back into the steam circuit.

In order to prevent reverse flow through the secondary preheat line 22 when the branch 20 is in flow mode, the secondary preheat line 22, in an exemplary embodiment, can include a valve 25, as shown in FIGS. 2-4, that can be shut during flow mode when reverse flow is most likely. In an exemplary embodiment, the valve 25 can be an actuated valve thus enabling automated operation of the valve 25. In another exemplary embodiment, the valve 25 can be a check valve or other pipe device to prevent reverse flow.

In an exemplary embodiment, the branch 20 is fitted with a temperature controller for controlling the temperature in the branch 20 during no flow mode. In an exemplary embodiment, the controller can include a flow restriction device 31, as shown in FIG. 3. The flow restriction devices 31 can be a flow orifice, or flow tube, fitted in either or both the first preheat line 21 or the second preheat line 22 (not shown). Thus fitted, the flow restriction device 31 can ensure a predetermined flow rate of unsuperheated steam can be provided through the branch 20, when in no flow mode, in a cheap and technically simple way.

In another exemplary embodiment, shown in FIG. 4, the controller can include: a flow modulating valve 26 in both the first preheat line 21 and the cooling medium feed line 23 of the steam desuperheater 18; and a temperature measurement device 30 in the branch 20 for measuring the temperature of the branch 20. These control elements are elements of a logic controller such as a processor coupled to a memory that uses known control means to modulate the modulating valves 26 based on measurements taken from the temperature measurement device 30 during both no flow and flow modes.

The control of temperature in the branch 20 is not however limited to these two controller configurations and as such can, for example, include elements from each of these control schemes, or else incorporate other suitable control elements.

An exemplary method for configuring an exemplary steam plant 10 shown in FIG. 1 and FIG. 2-4 for no flow mode, for example, when the branch valve 24 is shut, can include, in no particular order, the following; isolating the desuperheater cooling flow by, for example, closing a valve 25 in the cooling medium feed line 23 to the steam desuperheater 18; and opening, or ensuring open, valve 25 or valves 25 in either the first preheat line 21, the second preheat line 22 or both the first preheat line 21 and the second preheat line 22. The opening or ensuring open of the valve or valves 25 can enable sequential unsuperheated steam flow through the first preheat line 21, the branch 20 and the second preheat line 22.

An exemplary method for configuring an exemplary steam plant 10, shown in FIG. 1 and FIGS. 2-4 for flow mode, for example, when the branch valve 24 is open, can include, in no particular order; establishing cooling flow to the steam desuperheater 18, by, for example opening valve or valves 25 in the cooling medium feed line 23; and closing or ensuring closed the valve 25 in the second preheat line 22.

Although the disclosure has been herein shown and described in what are considered to be the most preferred exemplary embodiments, the present disclosure can be embodied in other specific forms. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

REFERENCE NUMBERS

10 Steam plant
12, 12*a*, 12*b* Steam turbine
13 Vent line
14 Relief valve
15 Preheater
16 Steam superheater
18 Steam desuperheater
18*a* Steam desuperheater—mixer

18*b* Steam desuperheater—water injection cooler
20 Branch
21 First preheat line
22 Second preheat line
23 Cooling medium feed line
24 Branch valve
25 Valve
26 Flow modulating valve
30 Temperature measurement device
31 Flow restricting device

What is claimed is:

1. A steam plant comprising:

a steam circuit;

a superheater in the steam circuit defining a boundary between a superheated steam region and an unsuperheated steam region;

a branch diverging from the superheated steam region of the steam circuit, the branch including:

a branch valve, and a steam desuperheater, upstream of the branch valve, having a cooling medium feed line;

a first preheat line connected at a first end to an unsuperheated steam region and at a second end, to a first end region of the branch; and a second preheat line connected at a first end, to a second end region of the branch, upstream of the branch valve, distal and opposite the first end region and at a second end, to a point of the steam circuit that in operation has a lower pressure than the unsuperheated region to which the first preheat line is connected, so as to enable sequential steam flow through the first preheat line, the branch and the second preheat line respectively when the branch valve is closed;

wherein the first end region is an upstream region of the branch and the second end region is a downstream region of the branch; and the steam plant further comprising a high pressure steam turbine and a low pressure steam turbine, wherein the second end of the second preheat line is connected upstream of the low pressure steam turbine.

2. The steam plant of claim 1, wherein the branch is a steam turbine bypass.

3. The steam plant of claim 1 wherein the branch is a vent line and the branch valve is a relief valve.

4. The steam plant of claim 1, comprising:

a valve located in the second preheat line.

5. The steam plant of claim 4 wherein the valve is an actuated valve.

6. The steam plant of claim 1, comprising:

a temperature control system for controlling temperature in the branch when the branch valve is shut.

7. The steam plant of claim 6, wherein the temperature control system comprises:

a flow-restricting device in at least one of the first preheat line and the second preheat line.

8. The steam plant of claim 6, wherein the temperature control system comprises:

a flow modulating valve in the first preheat line;

a flow modulating valve in the cooling medium feed line of the steam desuperheater;

a temperature measurement device in the branch for measuring temperature of the branch; and a controller, configured to control the temperature in the branch measured by the temperature measurement device by modulating the flow modulating valves of the first preheat line and the cooling medium feed line.

9. A method for controlling a steam plant, having a superheater in a steam circuit for defining a boundary between a superheated steam region and an unsuperheated steam region, wherein a branch diverging from the superheated steam region of the steam circuit includes a branch valve and a steam desuperheater with a cooling medium feed line, wherein a first preheat line is connected at a first end to an unsuperheated steam region and at a second end to a first end region of the branch, and wherein a second preheat line is connected at a first end to a second end region of the branch upstream of the branch valve which is distal and opposite the first end region, and at a second end to a point of the steam circuit that in operation has a lower pressure than the unsuperheated region to which the first preheat line is connected, so as to enable sequential steam flow through the first preheat line, the branch and the second preheat line respectively when the branch valve is closed, wherein the first end region is an upstream region of the branch and the second end region is a downstream region of the branch; and wherein the steam plant further comprises a high pressure steam turbine and a low pressure steam turbine, wherein the second end of the second preheat line is connected upstream of the low pressure steam turbine;

the method comprising:

closing the branch valve;

isolating a cooling medium flow from the steam desuperheater; and opening a valve in at least one of the first preheat line and the second preheat line to enable sequential flow of unsuperheated steam through the first preheat line, the branch and the second preheat line.

* * * * *